US008511654B2

(12) United States Patent
Bullard

(10) Patent No.: US 8,511,654 B2
(45) Date of Patent: Aug. 20, 2013

(54) DROP-IN GRID BASE FOR COIL UNITS

(75) Inventor: Larry I. Bullard, Winston Salem, NC (US)

(73) Assignee: L & P Property Management Company, South Gate, CA (US)

( * ) Notice: Subject to any disclaimer, the term of this patent is extended or adjusted under 35 U.S.C. 154(b) by 274 days.

(21) Appl. No.: 13/005,129

(22) Filed: Jan. 12, 2011

(65) Prior Publication Data

US 2012/0175829 A1 Jul. 12, 2012

(51) Int. Cl.
*F16F 3/04* (2006.01)

(52) U.S. Cl.
USPC ..... 267/91; 267/103

(58) Field of Classification Search
USPC ..... 267/81, 83, 84, 91, 93, 94, 95, 97, 267/99, 100, 101, 103, 105, 106; 297/452.49, 297/452.5, 452.52
See application file for complete search history.

(56) References Cited

U.S. PATENT DOCUMENTS

| | | | | |
|---|---|---|---|---|
| 1,525,675 | A | | 2/1925 | Van Orman |
| 2,309,239 | A | * | 1/1943 | Clark ..... 267/94 |
| 2,841,209 | A | | 7/1958 | Wetzler |
| 2,945,245 | A | * | 7/1960 | Gleason ..... 267/91 |
| 4,426,070 | A | | 1/1984 | Garceau et al. |
| 4,480,823 | A | | 11/1984 | Marcinczyk et al. |
| 5,165,667 | A | * | 11/1992 | Dabney ..... 267/103 |
| 5,197,155 | A | * | 3/1993 | Ogle et al. ..... 267/103 |
| 5,375,820 | A | | 12/1994 | Adams |
| 5,924,682 | A | | 7/1999 | Bullard |

* cited by examiner

*Primary Examiner* — Thomas J Williams
(74) *Attorney, Agent, or Firm* — Shook, Hardy & Bacon L.L.P.

(57) ABSTRACT

A drop-in grid base for coil units is provided. A plurality of extruded plastic tubes, plastic-covered wire profiles, and cross wires are arranged in substantially the same plane to form a grid foundation. The cross wires intersect the extruded plastic tubes and wire profiles. Base wires having a series of shallow, v-shaped notches are interwoven in substantially the same plane as the grid foundation. The ends of the base wires are looped for attachment inside the seating cavity of a framed furniture product. A coil unit may be attached directly to the drop-in grid base. Alternatively, the drop-in grid base may be separately installed into a seating cavity frame, for later installation of a coil unit on top of the drop-in grid base.

17 Claims, 5 Drawing Sheets

DROP-IN GRID BASE FOR COIL UNITS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to a drop-in grid base for supporting coil units. More particularly, the invention relates to assembling a grid base that can be dropped into a frame structure, such as an upholstery frame of a furniture piece, and used to support coil units.

BACKGROUND OF THE INVENTION

In the manufacture of framed furniture products, such as upholstered furniture, spring foundations, or "coil units," require a suitable support base inside seating cavity frames. In providing such support, various textile materials are typically stretched and stapled across the bottom of seating cavity frames to form a woven support base. For example, woven polypropylene (i.e. Propex®) may be stretched across and attached to a seating cavity frame to provide support for coil units.

One problem with current woven support bases is in providing a suitable depth of support inside a seating cavity. For example, the height of a coil unit does not always match the height of the frame's seating cavity, which varies with the style and design of the framed furniture product. Therefore, attaching a woven support to the bottom of the seating cavity would be ineffective, as a coil unit on top of the woven support would sink below the upper edge of the frame. In other words, the seating surface of the furniture product would be caved in. Attempts have been made to attach woven support bases at various heights within the seating cavity, such that various depths of cavities for supporting coil units can be provided. Such attempts including using a separate inner wooden frame inside the framed seating cavity and/or utilizing split rails or slotted rails to secure the support base. However, attaching a woven support base at differing heights inside a seating cavity may result in inconsistent installation, and may be challenging when manufacturing multiple framed furniture products that require different heights of seating cavities to support each furniture piece's respective coil units.

Accordingly, a need exists for an easily-installed support base that may be utilized at various heights inside a seating cavity.

BRIEF SUMMARY OF THE INVENTION

The present invention generally relates to a drop-in grid base for installation at various heights within the seating cavity of a framed furniture product. Throughout the remainder of this application, reference will be made to the use of a drop-in grid base as a support platform for coil units in framed furniture products. It should be understood that the invention contemplates utilizing drop-in grid bases in various types of framed items, both wooden-framed furniture pieces and otherwise, and that the invention is not limited to the specific component into which the grid base is positioned, or "dropped" into. The coil units supported by a drop-in grid base may also vary. For example, in some embodiments, a drop-in grid base may support a single coil unit made up of multiple springs. In other embodiments, the drop-in grid base may support individual coils that are not joined into a single unit. The drop-in grid base for coil units is a novel support platform for installation at varying heights within the seating cavity of framed furniture products.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1A:
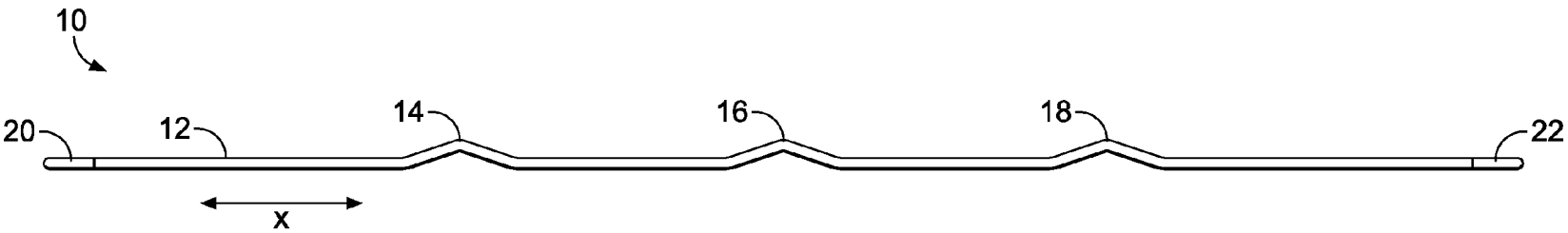
FIG. 1A is a side view of a base wire constructed according to one embodiment of the drop-in grid base.
Figure 1B:
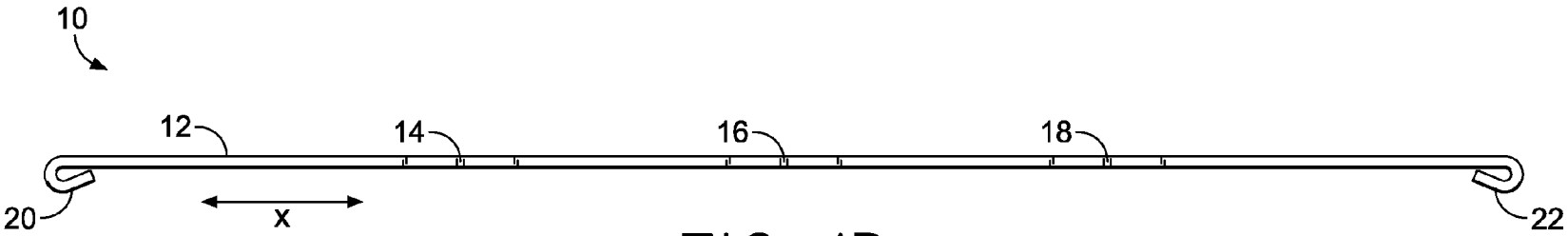
FIG. 1B is a bottom view of a base wire constructed according to one embodiment of the drop-in grid base.
Figure 2A:
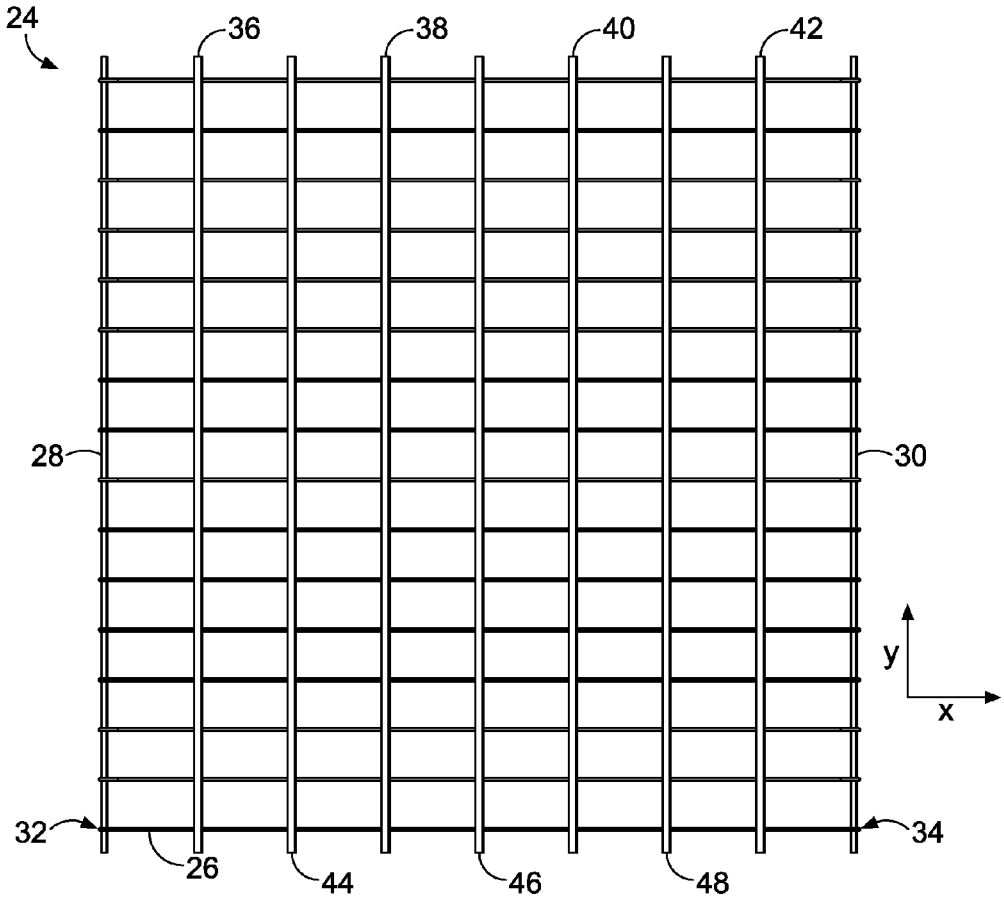
FIG. 2A is a bottom view of a grid foundation constructed according to one embodiment of the drop-in grid base.
Figure 2B:
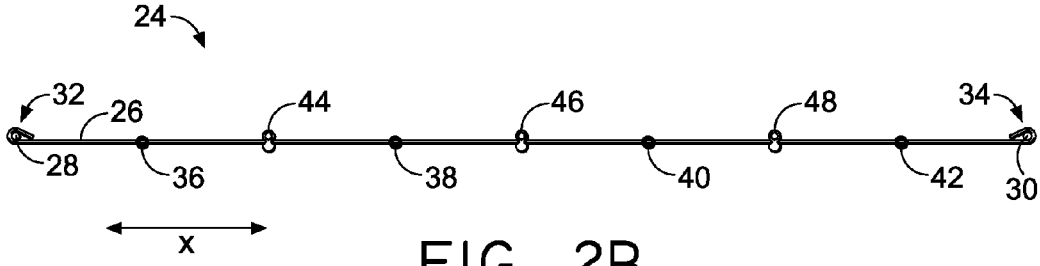
FIG. 2B is a side view of the grid foundation of FIG. 2A, with a cross wire intersecting the plastic tubes and plastic-covered wire profiles, constructed according to one embodiment of the drop-in grid base.
Figure 3:
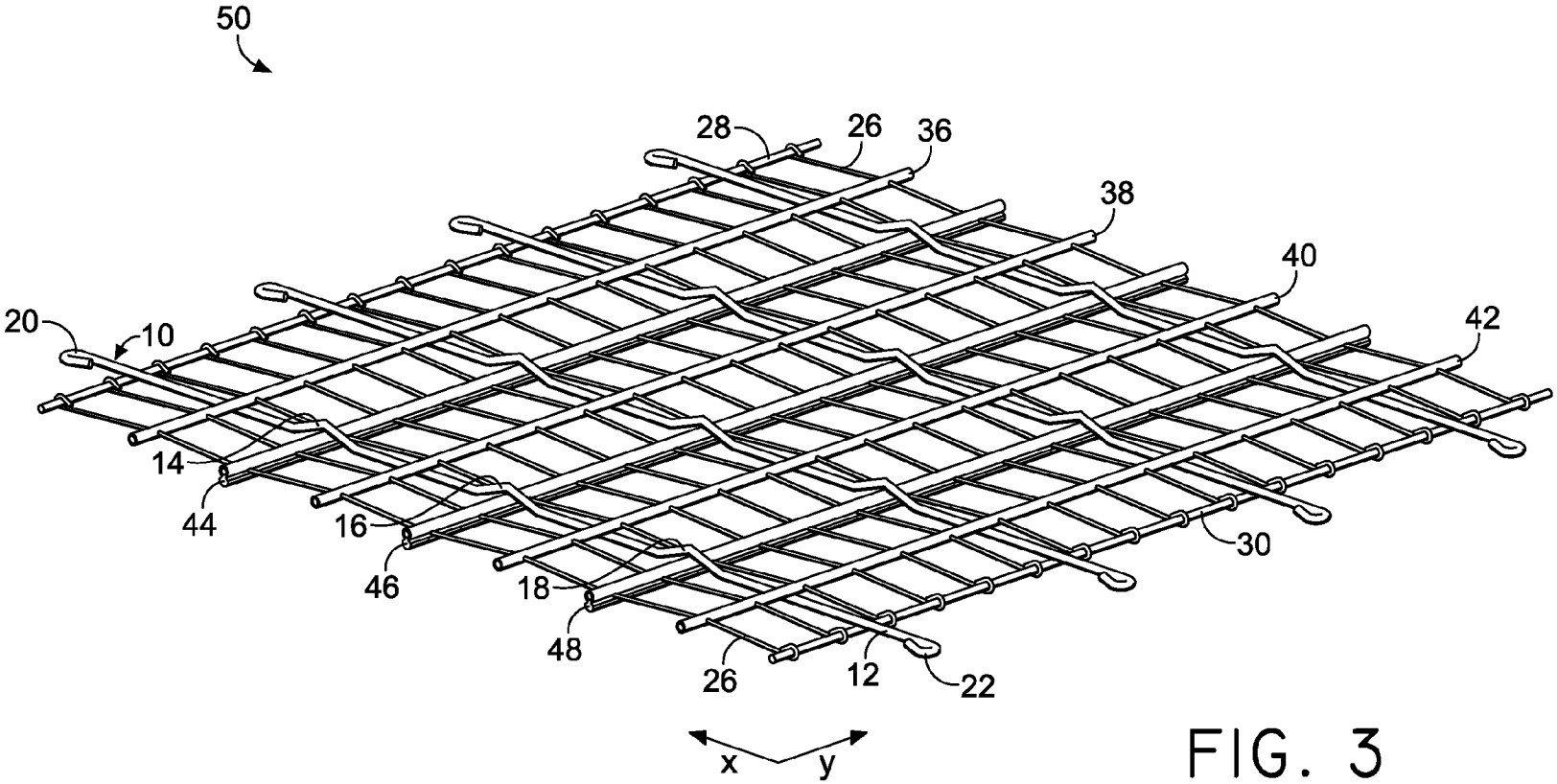
FIG. 3 is a bottom perspective view of the base wires of FIG. 1A interwoven into substantially the same plane as the grid foundation of FIG. 2A, constructed according to one embodiment of the drop-in grid base.

An embodiment of a drop-in grid base for coil units is seen in FIGS. 1-3. As shown in FIG. 1A, a side view of the base wire 10 includes a wire body 12 positioned lengthwise along a central axis "x." The wire body 12 of the base wire 10 includes a series of shallow, v-shaped notches 14, 16, and 18. In embodiments, the notches 14, 16, and 18 are configured to engage against another component of a drop-in grid base 50, such as the plastic-covered wire profiles of a grid foundation 24, which will be discussed later with reference to FIGS. 2A and 3. As will be understood, notches 14, 16, and 18 may be configured in any shape, such as "u-shaped" or "c-shaped" notches, that engage against another component of the drop-in grid base 50. Additionally, base wire 10 may include any number of notches along the wire body 12, which may also be spaced in any configuration along the wire body 12. In one embodiment, notches 14, 16, and 18 are evenly spaced along the wire body 12, and are able to engage against evenly-spaced components of the drop-in grid base 50.

The wire body 12 also includes axially-opposed first end 20 and second end 22. In embodiments, first end 20 and second end 22 engage and/or attach a drop-in grid base 50 into the seating cavity of a framed furniture product. For example, the first and second ends 20 and 22 may attach to screws, staples, nails, and/or other attachment surfaces inside a seating cavity frame. In order to engage against these surfaces, first and second ends 20 and 22 may be curved, looped, bent, straight, or otherwise configured to engage against the attachment surface inside a seating cavity. As best shown in the embodiment depicted in FIG. 1B, the first and second ends 20 and 22 are curved. The depth at which such attachment surfaces are positioned inside the seating cavity frame may vary, depending on several factors, such as the height of the coil unit being supported by an attached drop-in grid base 50. In one embodiment, a shallow set of coils may require a shallow support depth inside a seating cavity. As such, the first and second ends 20 and 22 may be attached at a shallow depth within the seating cavity.

In FIG. 1B, a bottom view along the central axis "x" of the base wire 10 depicts the wire body 12, having notches 14, 16, and 18, when viewed from below. In the illustrated embodiment, first end 20 and second end 22 are formed into a closed loop. In some embodiments, this closed-loop formation enables the first and second ends 20 and 22 to engage against and/or attach to an attachment surface in a seating cavity. In other embodiments, the first end 20 and second end 22 may be opened curves, such as hooks, which are also capable of engaging against and/or attaching to an attachment surface. As such, the base wire 10 may be used to "drop in" a grid base into a seating cavity, with the first and second ends 20 and 22 attaching to various heights of attachment surfaces inside a framed furniture product's seating cavity.

As shown in FIG. 2A, a bottom view of a grid foundation 24 includes a series of cross-wires 26 positioned parallel to a first axis "x." The cross wires 26 are engaged against and/or attached to border wires 28 and 30, which are aligned along a second axis "y." The cross wires 26 are attached to the border wires 28 and 30 at a first wrapped end 32 and a second wrapped end 34. In some embodiments, the cross wires 26 are attached to the border wires 28 and 30 without being wrapped around the border wires 28 and 30, such as being glued, welded, or otherwise joined to the surface.

The grid foundation 24 also includes a series of extruded plastic tubes 36, 38, 40 and 42, and a series of plastic-covered wire profiles 44, 46, and 48, which are positioned parallel to the y axis. In embodiments, the extruded plastic tubes 36, 38, 40, and 42 are a flexible plastic material that is incorporated into the grid foundation 24, and subsequently interwoven with one or more base wires 10. In further embodiments, the plastic-covered wire profiles 44, 46, and 48 include a central wire covered by a plastic coating (i.e. a Plasteel), which is incorporated into the grid foundation 24, and subsequently interwoven with one or more base wires 10. In forming the grid foundation 24, the cross wires 26, extruded plastic tubes 36, 38, 40 and 42, and plastic-covered wire profiles 44, 46, and 48, are arranged in substantially the same plane. Reference to "substantially" the same plane indicates that, although the components of the grid foundation 24 are arranged along an x axis and a y axis, the flexibility of the grid foundation 24 creates a unified surface that is evenly distributed, with only minor variations from the plane indicated by the x and y axes.

As shown in FIG. 2B, a side view of the grid foundation 24 depicts the cross wire 26 intersecting the series of extruded plastic tubes 36, 38, 40, and 42, and the series of plastic-covered wire profiles 44, 46, and 48. In one embodiment, a cross-section of the plastic-covered wire profiles 44, 46, and 48 has an "hourglass" shape, such that the cross wire 26 intersects the middle of the plastic-covered wire profile. Also depicted in FIG. 2B are the first wrapped end 32 and second wrapped end 34 of the cross wire 26, which are wrapped around the border wires 28 and 30.

Turning next to FIG. 3, a bottom perspective view of the drop-in grid base 50 is shown, which includes a number of the base wires 10 of FIG. 1A interwoven into substantially the same plane as the grid foundation 24 of FIG. 2A. The cross wires 26 and the wire bodies 12 of the base wires 10 are positioned along a first axis "x," while the extruded plastic tubes 36, 38, 40, and 42, and plastic-covered wire profiles 44, 46, and 48, are positioned along a second axis "y." The first end 20 and second end 22 of the base wire 10 extend beyond the border wires 28 and 30, which are positioned along the y axis. Viewed from below the drop-in grid base 50, the base wires 10 are interwoven into substantially the same plane as the cross wires 26, extruded plastic tubes 36, 38, 40, and 42, and plastic-covered wire profiles 44, 46, and 48. As such, the v-shaped notches 14, 16, and 18 of the wire body 12 are engaged against the plastic-covered wire profiles 44, 46, and 48, respectively. Similarly, the wire body 12 is also in contact with the surface of the extruded plastic tubes 36, 38, 40, and 42.

As previously discussed, reference to "substantially" the same plane indicates that, although the components of the drop-in grid base 50 are arranged along an x axis and a y axis, the flexibility of the drop-in grid base 50 creates a unified surface that is evenly distributed, with only minor variations from the plane indicated by the x and y axes. Further, in some embodiments, although the grid foundation 24 may form a uniform and/or level surface, interweaving the grid foundation 24 with the base wires 10 (having a more rigid structure than the grid foundation 24) may cause the surface of the drop-in grid base 50 to vary slightly above and below the plane indicated by the x and y axes. In embodiments, interweaving the base wires 10 into the grid foundation 24 includes positioning the base wire 10 directly above the extruded plastic tubes 36, 38, 40 and 42, and directly below the plastic-covered wire profiles 44, 46, and 48, and below the border wires 28 and 30.

Figure 4:
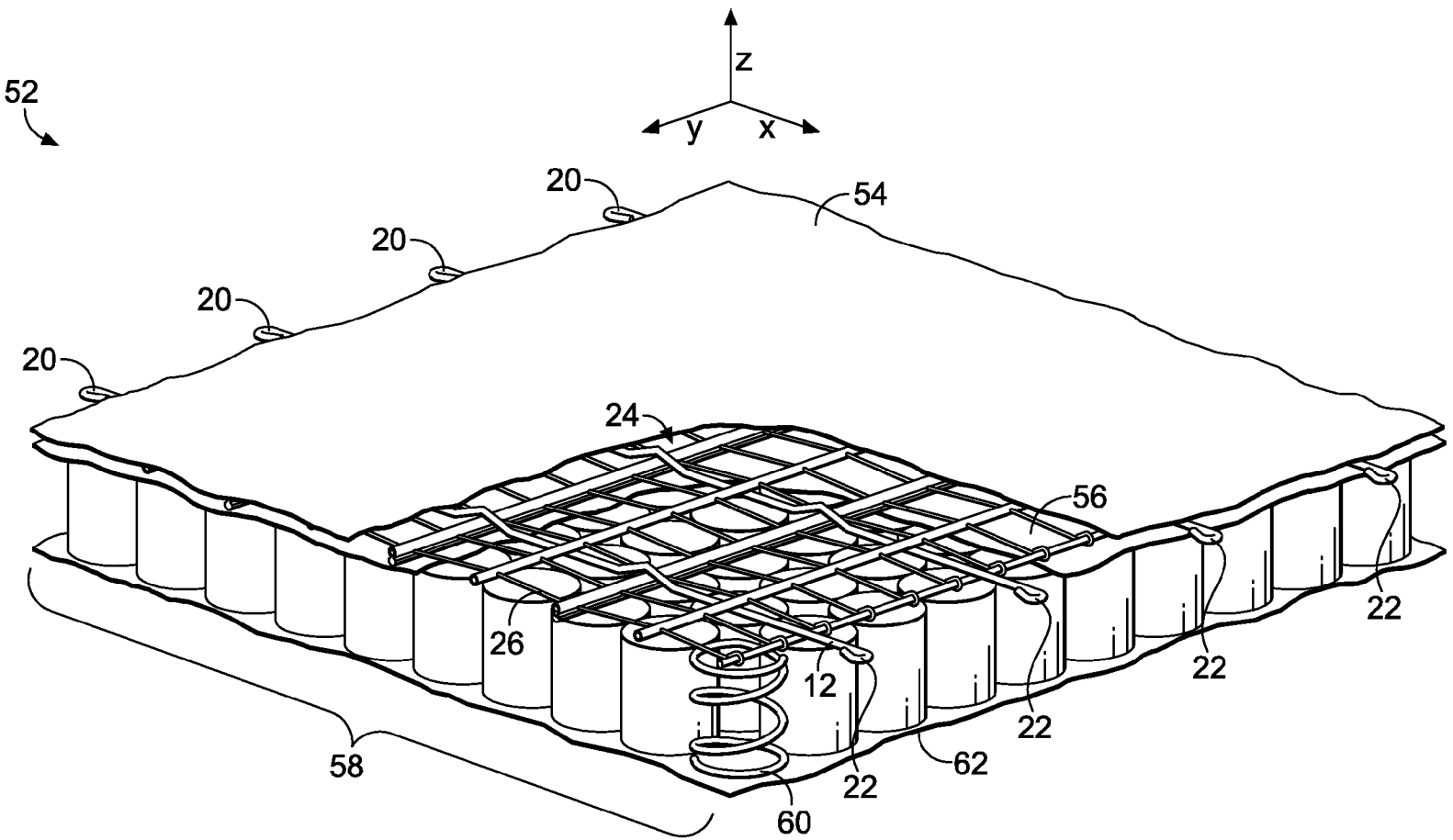
FIG. 4 is a bottom perspective view of the drop-in grid base of FIG. 3 sandwiched between two sheets of fabric and attached to a coil unit, constructed according to one embodiment of the drop-in grid base.

In FIG. 4, a combined grid base and coil unit 52 is shown from a bottom perspective view. The combined grid base and coil unit 52 includes the drop-in grid base 50 of FIG. 3, sandwiched between a first sheet of fabric 54 and a second sheet of fabric 56, and attached to a covered coil unit 58. The drop-in grid base 50 is positioned along a first axis "x" and a second axis "y," while the covered coil unit 58 is positioned along a third axis "z" that extends out of the plane formed by the x and y axes. As shown in FIG. 4, the first ends 20 and second ends 22 of the base wires 10 extend beyond the edge of the first and second sheets of fabric 54 and 56.

A portion of the first sheet of fabric 54 is cut away to reveal the bottom of the drop-in grid base 50, while a portion of the second sheet of fabric 56 is cut away to reveal the covered coil unit 58 that is attached to the drop-in grid base 50. The covered coil unit 58 may be attached to the drop in grid base 50 using the second sheet of fabric 56. In one embodiment, the first sheet of fabric 54 and the second sheet of fabric 56 are adhered to the bottom and top surfaces, respectively, of the drop-in grid base 50 using an adhesive. Additionally, an adhesive may be used to attach the covered coil unit 58 to the second sheet of fabric 56. In another embodiment, the covered coil unit 58 is further unified by being adhered to the third sheet of fabric 62.

An exposed coil 60 is shown as part of the covered coil unit 58. In further embodiments, a coil unit attached to the drop-in grid base 50 is fully exposed so that each individual coil attached to the drop-in grid base 50 may be viewed. As will be understood, a coil unit attached to a drop-in grid base 50 may use a different attachment method than one or more sheets of adhered fabric. For example, a coil unit may be attached to a drop-in grid base 50 using clip attachments.

Figure 5A:
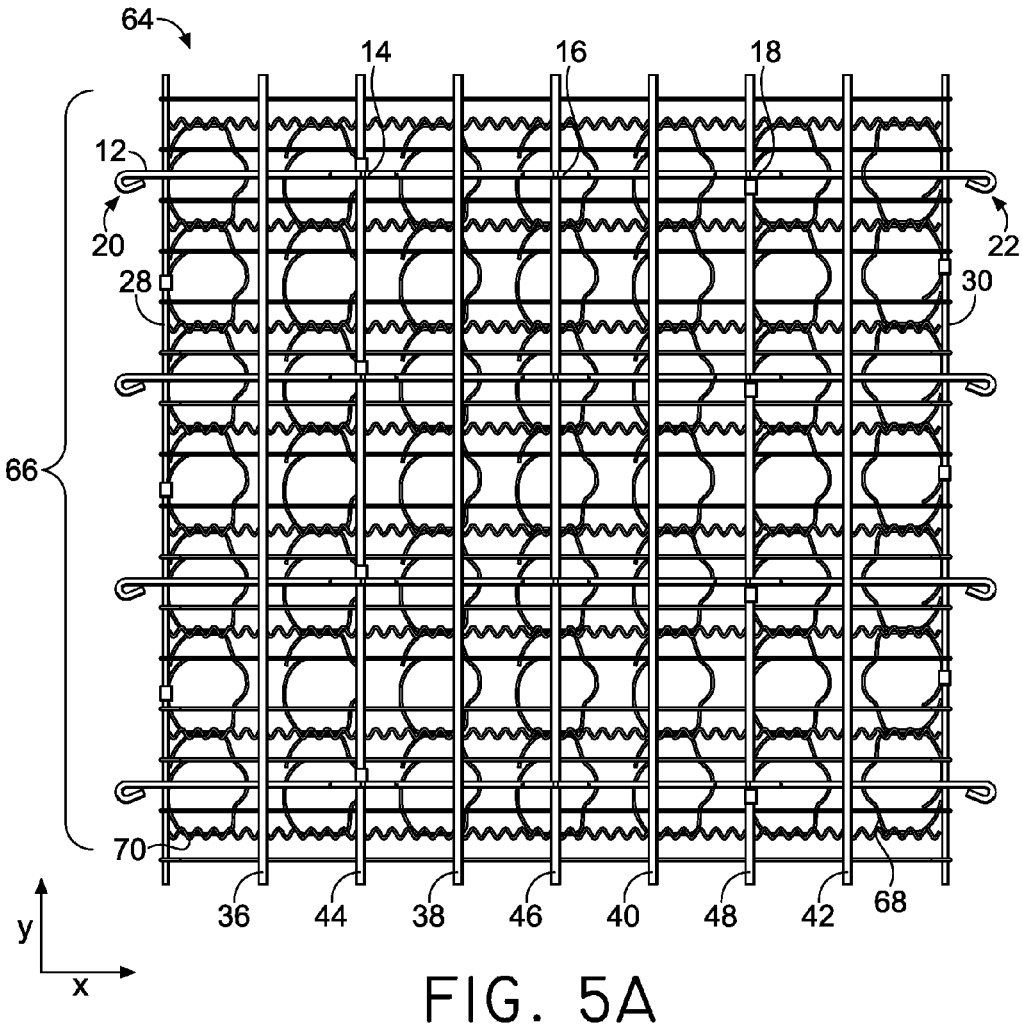
FIG. 5A is a bottom view of the drop-in grid base of FIG. 3 attached to a coil unit made up of a series of individual exposed coils, constructed according to one embodiment of the drop-in grid base.

Referring now to FIG. 5A, a grid base attached to exposed coils 64 is shown from a bottom view. The grid base attached to exposed coils 64 extends along the plane formed by the x and y axes, and includes an exposed coil unit 66 having a series of individual coils 68 attached to the drop-in grid base 50. The wire bodies 12 of the base wires 10 are positioned along a first axis "x," while the extruded plastic tubes 36, 38, 40, and 42, and plastic-covered wire profiles 44, 46, and 48, are positioned along a second axis "y." The base wires 10 are interwoven into substantially the same plane as the cross wires 26, extruded plastic tubes 36, 38, 40, and 42, and plastic-covered wire profiles 44, 46, and 48. As such, the v-shaped notches 14, 16, and 18 of the wire body 12 are engaged against the plastic-covered wire profiles 44, 46, and 48, respectively. Similarly, the wire body 12 is also in contact with the surface of the extruded plastic tubes 36, 38, 40, and 42. The first ends 20 and second ends 22 of the base wires 10 extend beyond the border wires 28 and 30, which are positioned along the y axis.

Figure 5B:
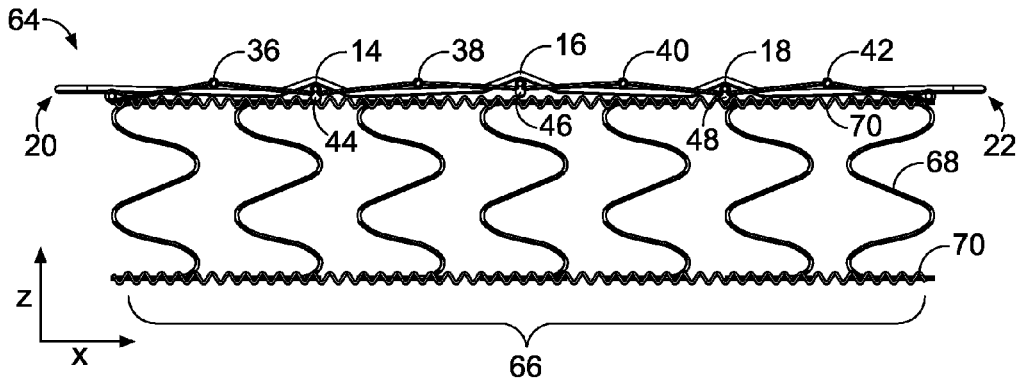
FIG. 5B is a side view of the drop-in grid base of FIG. 5A, constructed according to one embodiment of the drop-in grid base.

A series of helical attachment wires 70 attach the individual exposed coils to each other to unitize them into a coil unit 66. The exposed coil unit may then be attached to the drop-in grid base 50 by means of such clip attachments. A side view of the grid base attached to exposed coil units 64 is shown in FIG. 5B, which depicts the individual coils 68 extending along a third axis "z" with respect to the plane of the drop-in grid base 50.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A drop-in grid base for supporting coil units, the drop-in grid base comprising:

a grid foundation including:

(1) a plurality of plastic tubes;

(2) a plurality of plastic-covered wire profiles; and (3) a plurality of cross wires, each of the plurality of cross wires intersecting at least one of the plurality of plastic tubes and at least one of the plurality of plastic-covered wire profiles, wherein the plurality of plastic tubes, plurality of wire profiles, and plurality of cross wires are arranged in substantially the same plane; and at least one base wire interwoven in substantially the same plane as the grid foundation, wherein the at least one base wire includes one or more notches for engaging one or more of the plurality of plastic-covered wire profiles, and further wherein at least one end of the at least one base wire is configured to engage against a frame, wherein the at least one base wire is interwoven in substantially the same plane as the grid foundation by being positioned directly above the plurality of plastic tubes relative to the plane of the grid foundation and positioned directly below the plurality of plastic-covered wire profiles relative to the plane of the grid foundation.

2. The drop-in grid base of claim 1, wherein the plurality of cross wires intersect each of the plurality of plastic tubes and each of the plurality of wire profiles.

3. The drop-in grid base of claim 1, wherein the grid foundation includes one or more border wires on at least one side of the grid foundation, wherein the one or more border wires are arranged in substantially the same plane as the grid foundation.

4. The drop-in grid base of claim 3, wherein at least one end of one or more of the plurality of cross wires is attached to the one or more border wires.

5. The drop-in grid base of claim 1, wherein the drop-in grid base is attached to a coil unit.

6. The drop-in grid base of claim 1, wherein the at least one end of the at least one base wire is looped.

7. A method of manufacturing a drop-in grid base for supporting coil units, the method comprising:

arranging a plurality of plastic tubes, a plurality of plastic-covered wire profiles, and a plurality of cross wires in substantially the same plane to form a grid foundation, each of the plurality of cross wires intersecting at least one of the plurality of plastic tubes and at least one of the plurality of plastic-covered wire profiles; and interweaving at least one base wire in substantially the same plane as the grid foundation, wherein the at least one base wire includes one or more notches for engaging one or more of the plurality of plastic-covered wire profiles, and further wherein at least one end of the at least one base wire is configured to engage against a frame, wherein interweaving the at least one base wire in substantially the same plane as the grid foundation comprises positioning the at least one base wire directly above the plurality of plastic tubes relative to the plane of the grid foundation and positioning the at least one base wire directly below the plurality of wire profiles relative to the plane of the grid foundation.

8. The method of claim 7, wherein the plurality of cross wires intersect each of the plurality of plastic tubes and each of the plurality of wire profiles.

9. The method of claim 7, wherein the grid foundation includes one or more border wires on at least one side of the grid foundation, wherein the one or more border wires are arranged in substantially the same plane as the grid foundation.

10. The method of claim 9, wherein at least one end of one or more of the plurality of cross wires is attached to the one or more border wires.

11. The method of claim 7, wherein the method further comprises attaching a coil unit to the grid base.

12. A drop-in grid base for supporting coil units, the drop-in grid base comprising:

one or more plastic tubes;

one or more plastic-covered wire profiles;

one or more cross-wires intersecting at least one of the one or more plastic tubes and at least one of the one or more plastic-covered wire profiles, wherein the one or more plastic tubes, one or more plastic-covered wire profiles, and one or more cross-wires are arranged substantially the same plane to form a grid foundation; and one or more base wires interwoven in substantially the same plane as the grid foundation, wherein the one or more base wires includes one or more notches for engaging at least one of the one or more plastic-covered wire profiles, and further wherein at least one end of one or more of the one or more base wires is configured to engage with a frame structure, wherein the one or more base wires are interwoven in substantially the same plane as the grid foundation by being positioned directly above the one or more plastic tubes, relative to the plane of the grid foundation, and positioned directly below the one or more wire profiles, relative to the plane of the grid foundation.

13. The drop-in grid base of claim 12, wherein the at least one end of the one or more base wires is looped.

14. The drop-in grid base of claim 12, further comprising one or more border wires arranged in substantially the same plane as the grid foundation, wherein at least one end of the one or more cross wires is attached to at least one of the one or more border wires.

15. The drop-in grid base of claim 14, wherein an end of the one or more base wires extends beyond an edge of the one or more border wires.

16. The drop-in grid base of claim 12, wherein the drop-in grid base is attached to a coil unit.

17. The drop-in grid base of claim 12, wherein the one or more cross wires intersect each of the one or more plastic tubes and each of the one or more plastic-covered wire profiles.

* * * * *